US009354538B2

(12) United States Patent
Seki et al.

(10) Patent No.: US 9,354,538 B2
(45) Date of Patent: May 31, 2016

(54) CHARGING DEVICE AND IMAGE FORMING APPARATUS INCORPORATING SAME

(71) Applicants: Hideyasu Seki, Chiba (JP); Satoshi Hatori, Kanagawa (JP); Takeshi Fukao, Kanagawa (JP); Yuta Kawashima, Kanagawa (JP)

(72) Inventors: Hideyasu Seki, Chiba (JP); Satoshi Hatori, Kanagawa (JP); Takeshi Fukao, Kanagawa (JP); Yuta Kawashima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/626,282

(22) Filed: Feb. 19, 2015

(65) Prior Publication Data

US 2015/0248075 A1 Sep. 3, 2015

(30) Foreign Application Priority Data

Mar. 3, 2014 (JP) ..... 2014-040202

(51) Int. Cl.
*G03G 15/02* (2006.01)
*G03G 15/00* (2006.01)

(52) U.S. Cl.
CPC ..... *G03G 15/0266* (2013.01); *G03G 15/80* (2013.01)

(58) Field of Classification Search
CPC G03G 15/0266; G03G 15/0283; G03G 15/80
See application file for complete search history.

(56) References Cited

U.S. PATENT DOCUMENTS

| | | | | |
|---|---|---|---|---|
| 5,835,821 | A * | 11/1998 | Suzuki et al. | 399/100 |
| 5,839,024 | A * | 11/1998 | May et al. | 399/89 |
| 2009/0067874 | A1 * | 3/2009 | Hoshio | 399/100 |

FOREIGN PATENT DOCUMENTS

| | | |
|---|---|---|
| JP | 63-149669 | 6/1988 |
| JP | 7-072704 | 3/1995 |
| JP | 7-072705 | 3/1995 |
| JP | 7-072711 | 3/1995 |
| JP | 7-072712 | 3/1995 |
| JP | 9-211936 | 8/1997 |
| JP | 2002-278224 | 9/2002 |
| JP | 2005-242390 | 9/2005 |

* cited by examiner

*Primary Examiner* — Sandra Brase
(74) *Attorney, Agent, or Firm* — Harness, Dickey & Pierce, P.L.C.

(57) ABSTRACT

A charging device includes a charger and a power supply circuit. The charger is disposed opposing a latent image bearer. The power supply circuit applies to the charger an alternating voltage obtained by superimposing a pulsating voltage on a direct-current voltage. The alternating voltage generates normal discharge from the charger to a surface of the latent image bearer and reverse discharge from the surface of the latent image bearer to the charger. A pulse ON time of a voltage component toward a reverse discharge side relative to a desired surface potential Vde of the latent image bearer is shorter than a pulse ON time of a voltage component toward a normal discharge side relative to the desired surface potential Vde of the latent image bearer.

17 Claims, 8 Drawing Sheets

CHARGING DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application No. 2014-040202, filed on Mar. 3, 2014, in the Japan Patent Office, the entire disclosure of which is hereby incorporated by reference herein.

BACKGROUND

1. Technical Field

Embodiments of this disclosure relate to a charging device that causes a charger to contact or come close to a surface of a latent image bearer and charges the surface of the latent image bearer. In addition, embodiments of this disclosure relate to an image forming apparatus such as a copy machine, a facsimile, and a printer that charges the latent image bearer serving as a charging target with the charging device.

2. Description of the Related Art

Image forming apparatuses are used as, for example, copiers, printers, facsimile machines, and multi-functional devices having at least one of the foregoing capabilities. Such an image forming apparatus may include a charging device to charge a photoconductor serving as a latent image bearer. As the charging device, for example, a contact charging device or a proximity charging device is known that causes a charger to contact or come close to a photoconductor to be a latent image bearer, applies a voltage to the charger, and charges the photoconductor. The charger includes, for example, a roller, a brush, or a blade and generates discharge between the charger and the photoconductor directly to charge the photoconductor.

The contact charging device or the proximity charging device uses, for example, a method (hereinafter, referred to as an "alternating current (AC) superimposing method") of applying an alternating voltage obtained by superimposing a pulsating voltage on a direct-current voltage to the charger. In the AC superimposing method, discharge (hereinafter, referred to as "normal discharge") from the charger to the photoconductor is generated and discharge (hereinafter, referred to as "reverse discharge") from the photoconductor to the charger is generated. The normal discharge and the reverse discharge are repeated several times, so that a charging state on a surface of a photoconductor drum becomes uniform gradually, and the charging unevenness is removed.

In addition, to suppress an amount of generation of discharge products in the AC superimposing method, for example, a technology prevents generation of the reverse discharge not contributing to charging of the photoconductor to reduce an amount of generation of ozone. Another technology decreases a discharge current amount to suppress an amount of generation of NOx, focusing on that the amount of generation of NOx at the time of the discharge is proportional to the discharge current amount from the charging device.

SUMMARY

In at least one aspect of this disclosure, there is provided an improved charging device including a charger and a power supply circuit. The charger is disposed opposing a latent image bearer. The power supply circuit applies to the charger an alternating voltage obtained by superimposing a pulsating voltage on a direct-current voltage. The alternating voltage generates normal discharge from the charger to a surface of the latent image bearer and reverse discharge from the surface of the latent image bearer to the charger. A pulse ON time of a voltage component toward a reverse discharge side relative to a desired surface potential Vde of the latent image bearer is shorter than a pulse ON time of a voltage component toward a normal discharge side relative to the desired surface potential Vde of the latent image bearer.

In at least one aspect of this disclosure, there is provided an improved image forming apparatus including the latent image bearer, the charging device, a latent image writing unit, a developing device, a transfer device, and a cleaning device. The charging device charges the surface of the latent image bearer. The latent image writing unit forms an electrostatic latent image on the surface of the latent image bearer charged by the charging roller. The developing device adheres toner to the electrostatic latent image on the latent image bearer and develops the electrostatic latent image into a toner image. The transfer device transfers the toner image from the latent image bearer to a transfer material. The cleaning device removes residual untransferred toner remaining on the latent image bearer after the toner image is transferred to the transfer material.

In at least one aspect of this disclosure, there is provided an improved process cartridge including the charging device, the cleaning device, and the latent image bearer of the image forming apparatus. The charging device, the cleaning device, and the latent image bearer are detachably attachable relative to a body of image forming apparatus as a single unit.

In at least one aspect of this disclosure, there is provided an improved charging device including a charger and a power supply circuit. The charger is disposed opposing a latent image bearer. The power supply circuit applies to the charger an alternating voltage obtained by superimposing a pulsating voltage on a direct-current voltage. The alternating voltage generates normal discharge from the charger to a surface of the latent image bearer and reverse discharge from the surface of the latent image bearer to the charger. An absolute value of a difference between a peak value of a voltage component toward a reverse discharge side relative to a desired surface potential Vde of the latent image bearer and the desired surface potential Vde of the latent image bearer is smaller than an absolute value of a difference between a peak voltage of a voltage component toward a normal discharge side relative to the desired surface potential Vde of the latent image bearer and the desired surface potential Vde of the latent image bearer.

In at least one aspect of this disclosure, there is provided an improved image forming apparatus including the latent image bearer, the charging device, a latent image writing unit, a developing device, a transfer device, and a cleaning device. The charging device charges the surface of the latent image bearer. The latent image writing unit forms an electrostatic latent image on the surface of the latent image bearer charged by the charging roller. The developing device adheres toner to the electrostatic latent image on the latent image bearer and develops the electrostatic latent image into a toner image. The transfer device transfers the toner image from the latent image bearer to a transfer material. The cleaning device removes residual untransferred toner remaining on the latent image bearer after the toner image is transferred to the transfer material.

In at least one aspect of this disclosure, there is provided an improved process cartridge including the charging device, the cleaning device, and the latent image bearer of the image forming apparatus. The charging device, the cleaning device, and the latent image bearer are detachably attachable relative to a body of image forming apparatus as a single unit.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
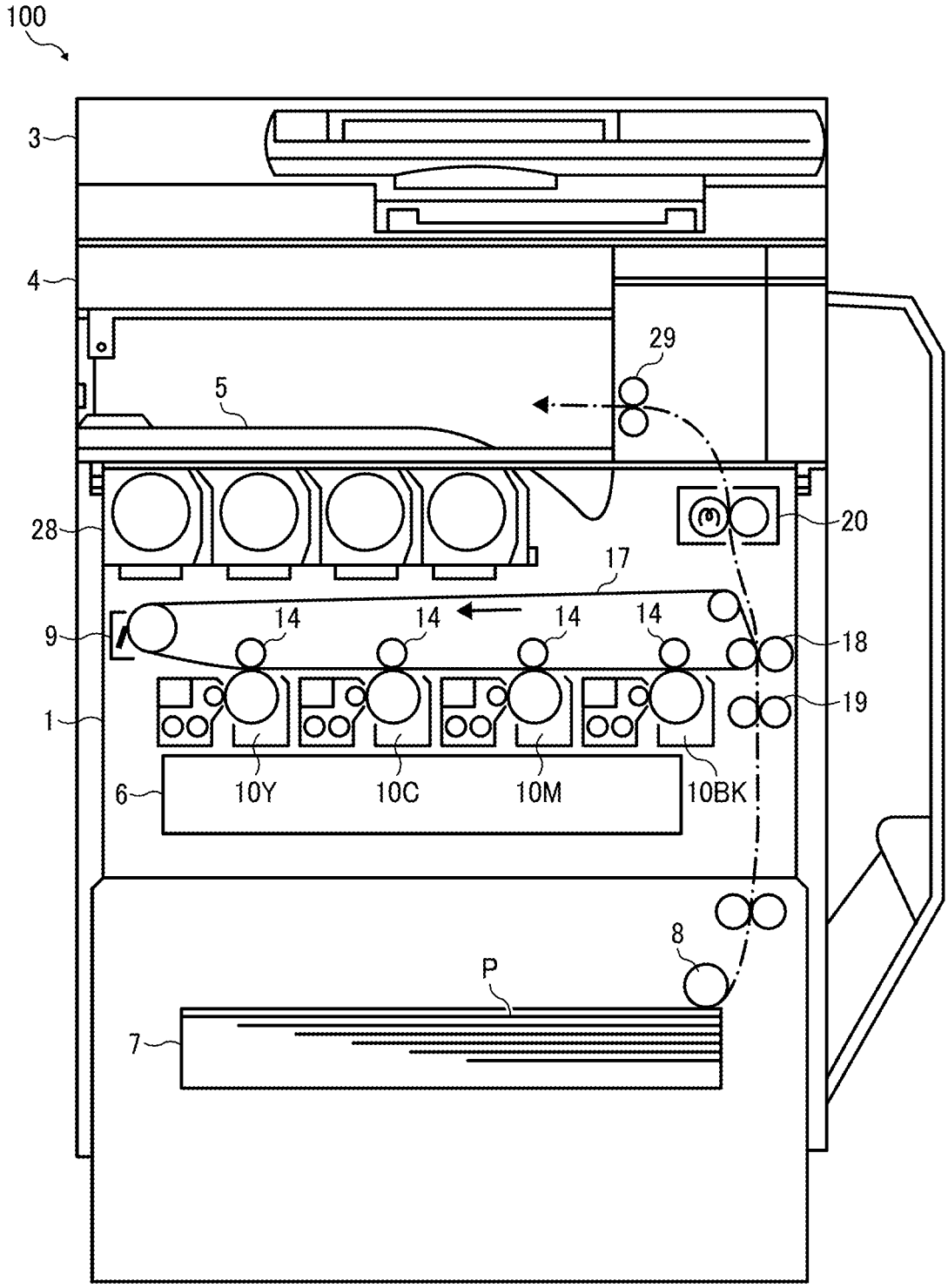
FIG. 1 is a schematic view of a configuration of a copy machine according to an embodiment of the present invention.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 9:
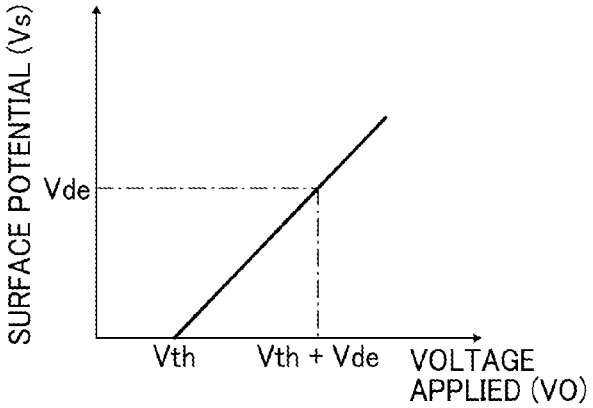
FIG. 9 is a graph illustrating a relation of an applied voltage and a surface potential of a photoconductor.

FIG. 9 is a graph illustrating a relation of a direct-current voltage value applied to the charger and a surface potential of the photoconductor. In FIG. 9, Vth shows a voltage (hereinafter, referred to as a "charging start voltage") where a surface of the photoconductor starts to be charged by discharge between the charger and the photoconductor and Vde shows a desired surface potential of the photoconductor. If an applied voltage is more than Vth, the surface potential of the photoconductor increases linearly (an inclination is 1). In order to charge the photoconductor surface with Vde, theoretically, the applied voltage needs to be Vth+Vde.

Figure 10:
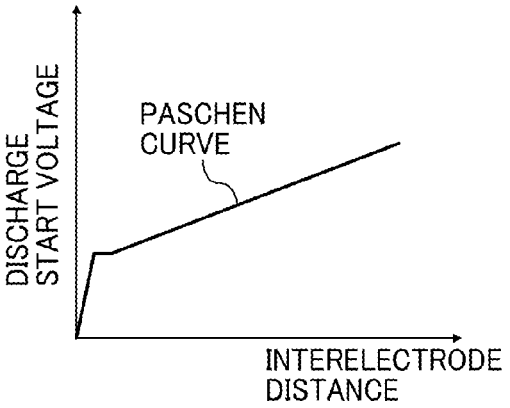
FIG. 10 is a graph illustrating a relation of an inter-electrode distance and a charge start voltage.

When the voltage of Vth+Vde is applied, places where discharge is generated first between the charger and the photoconductor are not only a contact portion or a nearest neighbor portion (hereinafter, referred to as a "gap of a short distance") of the charger and the photoconductor but also a place (hereinafter, referred to as a "gap of a long distance") where a distance of the charger and the photoconductor increases as compared with the contact portion or the nearest neighbor portion. This is based on the Paschen's law. FIG. 10 is a graph illustrating a relation of an inter-electrode distance and a discharge start voltage in the Paschen's law. If a voltage applied between the electrodes increases, the distance between the electrodes where discharge starts also increases.

In a method (hereinafter, referred to as a "direct current (DC) application method") of applying only a direct-current voltage in the contact charging device or the proximity charging device, the discharge between the charger and the photoconductor starts to be generated from not only the gap of the short distance but also the gap of the long distance, due to the reason described above. It is thought that one factor of so-called "charging unevenness" causing a problem in the DC application method is that the discharge is generated by the gap of the long distance.

The charging unevenness means a state in which the photoconductor is not charged uniformly and the surface potential of the photoconductor increases or decreases according to a place. A detailed mechanism by which the charging unevenness is generated does not become clear under the present conditions. When the discharge is generated through the gap of the long distance, an amount of charges moving until one discharge ends after one discharge starts increases as compared with when the discharge is generated through the gap of the short distance. This is associated with occurrence of the charging unevenness.

As technologies for removing the charging unevenness in the DC application method, various technologies such as strict control of a resistance value, a film thickness, and irregularity of a surface of the charger are disclosed. For example, a technology regulates the places where the discharge is generated by a discharge regulation member to prevent generation of the discharge in the gap of the long distance which is otherwise one factor of the charging unevenness.

However, the present inventors have conducted studies zealously and have found that, in the DC application method, the charger is more difficult to manufacture and a residual image or horizontal black streaks over time are likely to occur. In addition, the present inventors have found that a photoconductor of high durability can be realized in the case of a configuration of not generating the reverse discharge not contributing to a photoconductor in an AC superimposing method, but horizontal black streaks may occur in an area where the reverse discharge is not generated between the charger and the photoconductor. The present inventors have also found that the reverse discharge is preferably generated at an appropriate level (level at which the amount of generation of discharge products such as the ozone does not become excessive) to suppress the occurrence of the horizontal black streaks.

Figure 11A:
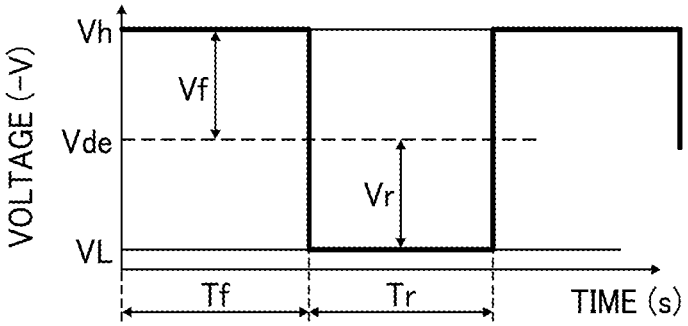
FIGS. 11A to 11C are graphs illustrating waveform examples of an alternating voltage in a current charging device.
Figure 11B:
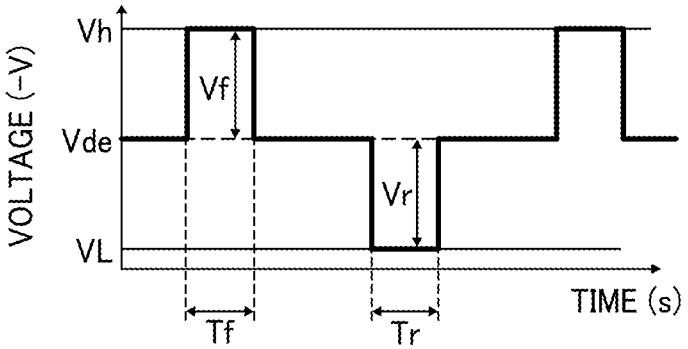
Figure 11C:
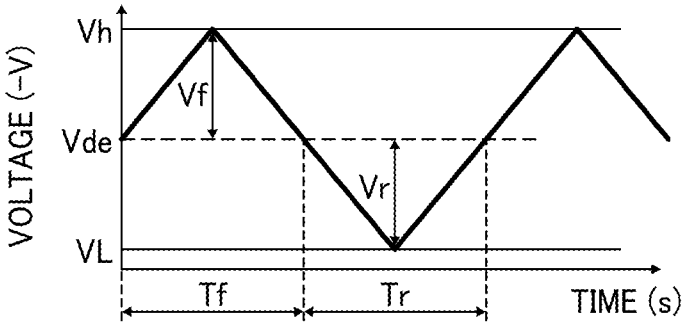

In addition, in a study process for realizing both the photoconductor having the high durability and the high image quality, the present inventors have found that deterioration of the photoconductor may be accelerated by the excessive reverse discharge in the case of a configuration of reducing a discharge current amount to suppress a generation amount of NOx. In an example, in an alternating voltage applied to a charging roller, a direct-current component is set to Vde and a pulsating component is set such that amplitudes are symmetrical around a potential 0. In waveform examples of an alternating voltage illustrated in FIGS. 11A to 11C, a voltage (hereinafter, referred to as a "normal discharge component voltage") toward a normal discharge side relative to a desired surface potential Vde of the photoconductor and a voltage (hereinafter, referred to as a "reverse discharge component voltage") toward a reverse discharge side relative to the desired surface potential Vde are repeated at the same amplitude and the same cycle. If the reverse discharge unnecessary for charging the photoconductor is repeated at the same level as the normal discharge, ions generated at the time of the reverse discharge may cut a molecular chain of the surface of the photoconductor excessively and a film thickness of the photoconductor may decrease. That is, deterioration of the photoconductor may be accelerated.

In view of the above-described circumstances, embodiments of the present invention provide a charging device and an image forming apparatus that can improve durability of a photoconductor while suppressing occurrence of horizontal black streaks, in an AC superimposing method.

First Embodiment

Hereinafter, embodiments of an image forming apparatus to which the present invention is applicable will be described. FIG. 1 is a schematic view of a copy machine 100 to be an image forming apparatus according to this embodiment. The copy machine 100 is a tandem-type color image forming apparatus in which image forming devices 10Y, 10C, 10M, and 10BK serving as a plurality of image forming units are arranged to face an intermediate transfer belt 17.

The copy machine 100 includes an apparatus body 1, a document reading unit 4 to read image data of a document, a document feeding unit 3 to feed the document to the document reading unit 4, a writing unit (exposure unit) 6 to emit laser light based on input image data, a sheet feeding unit 7 in which transfer sheets P to be recording media are stored, image forming devices 10Y, 10C, 10M, and 10BK serving as image forming units corresponding to individual colors (yellow, cyan, magenta, and black), an intermediate transfer belt 17 serving as an intermediate transfer body in which toner images of a plurality of images are overlapped and transferred, a secondary transfer roller 18 to transfer the toner images formed on the intermediate transfer belt 17 to the transfer sheets P, a fixing unit 20 to fix unfixed images on the transfer sheets P, and a toner container 28 to replenish toners of individual colors to respective developing devices of the four image forming devices 10Y, 10C, 10M, and 10BK.

Figure 2:
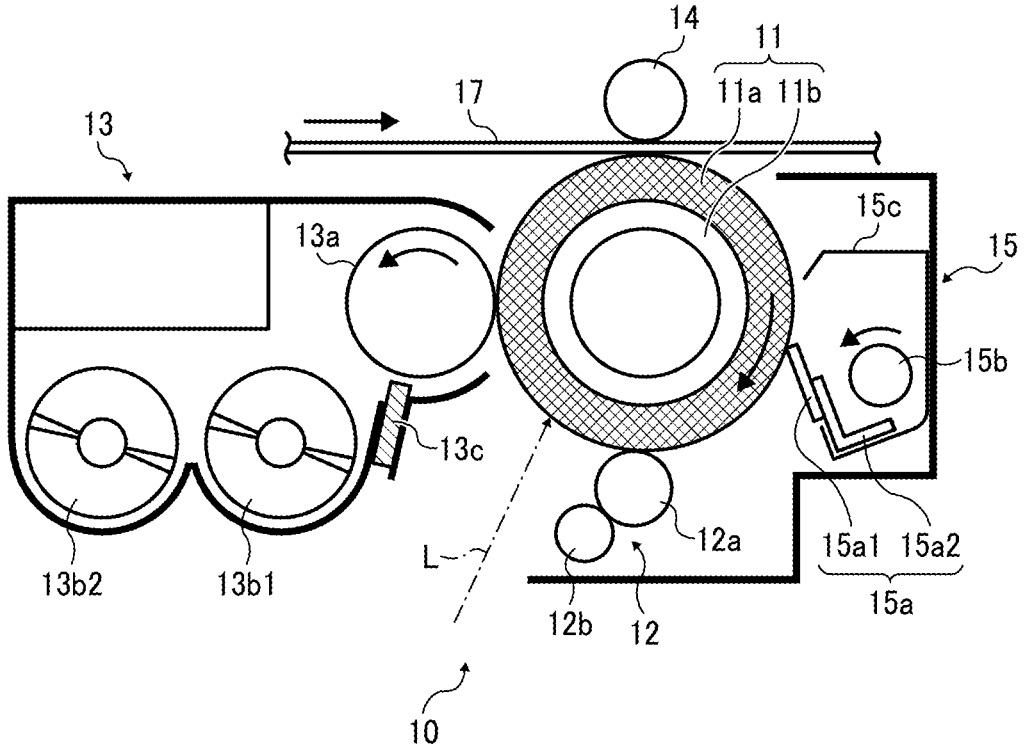
FIG. 2 is a schematic view of a configuration of an image forming device in the copy machine.

FIG. 2 is a schematic view of one of the four image forming devices 10Y, 10C, 10M, and 10BK. The four image forming devices 10Y, 10C, 10M, and 10BK have the same configuration, except that the colors of the toners to be used are different from each other. Therefore, in the following description, suffixes (Y, C, M, and BK) showing the colors of the toners to be used are appropriately omitted. As illustrated in FIG. 2, in each of the four image forming devices 10, a photoconductor drum 11 serving as an image bearer, a charging device 12, a developing device 13 serving as a developing unit, and a photoconductor cleaning device 15 serving as a cleaning unit are integrated to configure a process cartridge. Each of the four image forming devices 10Y, 10C, 10M, and 10BK serving as the process cartridge is attached to or detached from a body of the copy machine 100 and the image forming devices at the end of life are replaced by new image forming devices. The toner images of the individual colors (yellow, cyan, magenta, and black) are formed on the photoconductor drums 11 in the image forming devices 10Y, 10C, 10M, and 10BK, respectively.

An operation at the time of normal color image formation in the copy machine 100 will be described below. First, the document is fed from a document mount by a feeding roller of the document feeding unit 3 and is placed on a contact glass of the document reading unit 4. In addition, the image data of the document placed on the contact glass is optically read by the document reading unit 4. In detail, the document reading unit 4 irradiates an image of the document on the contact glass with light emitted from an illumination lamp and scans the image. In addition, the light reflected on the document forms an image on a color sensor through a mirror group and a lens.

After color image data of the document is read for each color separation light of RGB (red, green, and blue) by the color sensor, the color image data is converted into an electrical image signal. Processes such as a color conversion process, a color correction process, and a spatial frequency correction process are executed by an image processing unit on the basis of a color separation image signal of the RGB and color image data of yellow, cyan, magenta, and black is obtained.

The image data of the individual colors of yellow, cyan, magenta, and black is transmitted to the writing unit 6. In addition, the writing unit 6 irradiates the photoconductor drums 11 of the corresponding image forming devices 10Y, 10C, 10M, and 10BK with laser light serving as exposure light based on the image data of the individual colors.

Each of the four photoconductor drums 11 rotates in a clockwise direction in FIGS. 1 and 2. In addition, first, a surface of the photoconductor drum 11 is charged uniformly at a position facing the charging roller 12*a* of the charging device 12 (charging process). The charging roller 12*a* is pressed against the surface of the photoconductor drum 11 and rotates according to the rotation of the photoconductor drum 11. The charging device 12 will be described in detail below. Then, the charged surface of the photoconductor drum 11 reaches an emission position of each laser light.

In the writing unit 6, a light source emits the laser light corresponding to the image signal to correspond to each color. After the laser light is incident on a polygon mirror and is reflected on the polygon mirror, the laser light transmits a plurality of lenses. After transmitting the plurality of lenses, the laser light passes through a different optical path for each color component of yellow, cyan, magenta, and black (exposure process).

The laser light corresponding to the yellow component is emitted to the surface of the photoconductor drum 11 of the first yellow image forming device 10Y from the left side of FIG. 2. At this time, the laser light of the yellow component is scanned in a rotation axial direction (main-scanning direction) of the photoconductor drum 11 by the polygon mirror rotating at a high speed. In this way, an electrostatic latent image corresponding to the yellow component is formed on the photoconductor drum 11 charged by the charging roller 12*a*.

The laser light corresponding to the cyan component is emitted to the surface of the photoconductor drum 11 of the second cyan image forming device 10C from the left side of FIG. 1 and an electrostatic latent image corresponding to the cyan component is formed. The laser light corresponding to the magenta component is emitted to the surface of the photoconductor drum 11 of the third magenta image forming device 10M from the left side of FIG. 1 and an electrostatic latent image corresponding to the magenta component is formed. The laser light corresponding to the black component is emitted to the surface of the photoconductor drum 11 of the fourth black image forming device 10BK (image forming device on the most downstream side for a traveling direction of the intermediate transfer belt 17) from the left side of FIG. 1 and an electrostatic latent image of the black component is formed.

The surface of the photoconductor drum 11 on which the electrostatic latent image of each color is formed reaches a position facing the developing device 13. In addition, the toner of each color is supplied from each developing device 13 to the photoconductor drum 11 and a latent image on the photoconductor drum 11 is developed (developing process). Then, the surface of the photoconductor drum 11 after the developing process reaches a position facing the intermediate transfer belt 17. Here, a primary transfer roller 14 is arranged at the facing position to contact an inner circumferential surface of the intermediate transfer belt 17. In addition, the toner image of each color formed on the photoconductor drum 11 is sequentially overlapped and transferred to the intermediate transfer belt 17, at a primary transfer position facing the primary transfer roller 14 (primary transfer process).

The surface of the photoconductor drum 11 after the primary transfer process reaches a position facing the photoconductor cleaning device 15 on which a cleaning blade 15*a* illustrated in FIG. 2 is arranged. In addition, an untransferred toner remaining on the photoconductor drum 11 is collected by the photoconductor cleaning device 15 (cleaning process). Then, the surface of the photoconductor drum 11 passes through a position of a diselectrification unit and a series of image formation processes in the photoconductor drum 11 ends.

The surface of the intermediate transfer belt 17 to which the images of the individual colors on the photoconductor drum 11 are transferred in an overlapped state travels in a direction indicated by arrow and reaches a position of the secondary transfer roller 18. In addition, a full color image on the intermediate transfer belt 17 is secondarily transferred to the transfer sheet P, at the position of the secondary transfer roller 18 (secondary transfer process). Then, the surface of the intermediate transfer belt 17 reaches the position of the intermediate transfer belt cleaning device 9. In addition, the untransferred toner on the intermediate transfer belt 17 is collected to the intermediate transfer belt cleaning device 9 and a series of transfer processes on the intermediate transfer belt 17 is completed.

The transfer sheet P of the position of the secondary transfer roller 18 is conveyed from the sheet feeding unit 7 via a conveyance guide and a pair of registration rollers 19. In detail, the transfer sheet P fed from the sheet feeding unit 7 storing the transfer sheets P by the sheet feeding roller 8 passes through the conveyance guide and is then guided to the pair of registration rollers 19. The transfer sheet P that reaches the pair of registration rollers 19 matches timing with the toner image on the intermediate transfer belt 17 and is conveyed to the position of the secondary transfer roller 18.

The transfer sheet P to which the full color image is transferred is guided to the fixing unit 20. In the fixing unit 20, the color image is fixed on the transfer sheet P by a nip of a fixing roller and a pressing roller. In addition, the transfer sheet P after the fixing process is ejected as an output image to the outside of the apparatus body 1 by a pair of paper ejection rollers 29 and is then stacked on a paper ejection unit 5 and a series of image formation processes is completed.

The image forming device 10 of FIG. 2 will be described in detail below. In the image forming device 10, the photoconductor drum 11, the charging device 12 to charge the photoconductor drum 11, the developing device 13 to develop the electrostatic latent image formed on the photoconductor drum 11, and the photoconductor cleaning device 15 to collect the untransferred toner on the photoconductor drum 11 are integrally stored in a case.

The photoconductor drum 11 is a negatively charged organic photoconductor and is obtained by providing a photoconductive layer on a drum-shaped conductive support. The photoconductor drum 11 has a diameter of 30 [mm] and a length of about 374 [mm] and is obtained by forming a photoconductor 11*a* (having a thickness of about 40 [μm]) on a conductor 11*b*. The photoconductor drum 11 rotates in a direction indicated by arrow.

Figure 3:
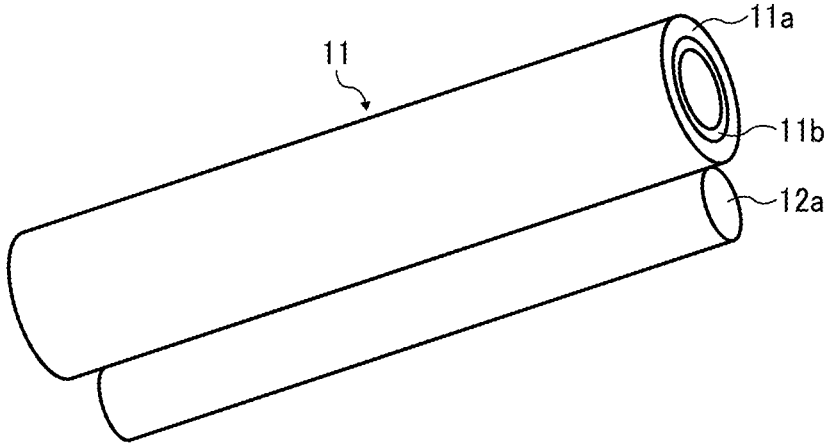
FIG. 3 is a schematic view of a configuration of a charging roller and a photoconductor of the image forming device.

As illustrated in FIG. 3, the charging roller 12*a* and the photoconductor 11*a* contact each other across an entire area in a longitudinal direction of the charger roller 12*a*. If the charging roller 12*a* and the photoconductor 11*a* do not contact each other, a variation occurs in a gap between the charging roller 12*a* and the photoconductor 11*a*. If the peak value of the normal discharge voltage component of the voltage applied to the charging roller 12*a* is set according to a place where the gap is widest not to cause a charging failure, a discharge hazard may increase in a place where the gap is narrow. The charging roller 12*a* and the photoconductor 11*a* contact across the entire area in the longitudinal direction of the charging roller 12*a*, so that the photoconductor 11*a* having the high durability can be obtained.

The developing device 13 mainly includes a developing roller 13*a*, a first transport screw 13*b*1, a second transport screw 13*b*2, and a doctor blade 13*c*. The developing roller 13*a* is arranged at a position facing the photoconductor drum 11 and the first transport screw 13*b*1 is arranged at a position facing the developing roller 13*a*. In addition, the second transport screw 13*b*2 faces the first transport screw 13*b*1 through a partition member and the doctor blade 13*c* is arranged at a position facing the developing roller 13*a* between the first transport screw 13*b*1 and the photoconductor drum 11.

The developing roller 13*a* includes a magnet that is fixed to an inner portion and forms a magnetic pole on a circumferential surface of a roller and a sleeve that rotates around the magnet. A plurality of magnetic poles are formed on the developing roller 13*a* (sleeve) by the magnet and a developer is carried on the developing roller 13*a*. In the developing device 13, a two-component developer including a carrier and a toner is stored.

In the photoconductor cleaning device 15, the cleaning blade 15*a*, a transport coil 15*b*, and a case 15*c* are arranged. The cleaning blade 15*a* is a cleaner that contacts the photoconductor drum 11. The transport coil 15*b* is a transport member that transports the toner (untransferred toner) collected in the photoconductor cleaning device 15 as a waste toner to a waste toner collection container at the outside of the photoconductor cleaning device 15 in a longitudinal direction. The case 15*c* is a casing member that covers circumference of the photoconductor cleaning device 15.

The cleaning blade 15*a* mainly includes a blade member 15*a*1 (blade body) that is formed of a rubber material such as urethane rubber and in formed in an approximately plate shape and a holder member 15*a*2 (blade holder) that is formed of a metal plate and holds the blade member 15*a*1. In addition, the blade member 15*a*1 of the cleaning blade 15*a* contacts the surface of the photoconductor drum 11 at a predetermined angle and a predetermined pressure. Thereby, adhesive materials such as the untransferred toner adhered to the photoconductor drum 11 are scraped mechanically by the cleaning blade 15*a* and are collected in the photoconductor cleaning device 15. Here, the adhesive materials adhered to the photoconductor drum 11 include paper particles generated from the transfer sheet P (paper), discharge products generated on the photoconductor drum 11 at the time of the discharge by the charging roller 12*a*, and additives added to the toner, in addition to the untransferred toner.

As illustrated in FIG. 2, the cleaning blade 15*a* is arranged in the photoconductor cleaning device 15. The cleaning blade 15*a* mainly includes the blade member 15*a*1 (blade body) that is formed of the rubber material and the holder member 15*a*2 (blade holder) that holds the blade member 15*a*1. Here, in the blade member 15*a*1, a protruding edge contacts the photoconductor drum 11 in a longitudinal direction (direction perpendicular to a sheet surface in FIG. 2) and a bottom portion is fixed to the holder member 15*a*2 and is held.

The image forming process will be described in detail using FIG. 2. The developing roller 13*a* rotates in a direction (counterclockwise direction) indicated by arrow in FIG. 2. The developer in the developing device 13 is transported in a longitudinal direction (direction perpendicular to a sheet surface in FIG. 2) by rotation of the first transport screw 13*b*1 and the second transport screw 13*b*2 arranged with the partition member therebetween and circulates through the developing device 13. At this time, the developer in the developing device 13 is transported while being stirred and mixed with a toner supplied from the toner container 28 by a toner replenishment unit.

The developer is stirred and mixed and is frictionally charged and the toner adsorbed into the carrier and the carrier are carried on the developing roller 13*a*. The toner carried on the developing roller 13*a* reaches a regulation position to be a position where the doctor blade 13*c* faces the developing roller 13*a*. In addition, an amount of the developer on the developing roller 13*a* is adjusted to an appropriate amount at the regulation position and the developer reaches a development area to be a position facing the photoconductor drum 11.

In the development area, the toner of the developer is adhered to the electrostatic latent image formed on the surface of the photoconductor drum 11. In detail, the toner is adhered to a latent image on the photoconductor drum 11 (a toner image is formed) by an electric field generated by a potential difference (developing potential) of a latent image potential (exposure potential) of an image area to which laser light L is emitted and a developing bias applied to the developing roller 13*a*.

Almost an entire portion of the toner adhered to the photoconductor drum 11 is transferred to the intermediate transfer belt 17. In addition, the untransferred toner remaining on the photoconductor drum 11 is cleaned by the cleaning blade 15*a* and is collected in the photoconductor cleaning device 15.

The toner replenishment unit provided in the apparatus body 1 of the copy machine 100 includes a bottle-shaped toner container 28 that can be replaced freely and a tonner hopper that holds and rotationally drives the toner container 28 and supplies a new toner to the developing device 13. In addition, the new toner (any one of yellow, cyan, magenta, and black) is stored in the toner container 28. In addition, in the toner container 28, a helical protrusion is formed on a bottle-shaped inner circumferential surface.

The new toner in the toner container 28 is appropriately supplied from a toner replenishment port to an inner portion of the developing device 13, according to consumption of the toner (existing toner) in the developing device 13. The consumption of the toner in the developing device 13 is detected directly or indirectly by a reflection-type photosensor facing the photoconductor drum 11 and a magnetic sensor arranged under the second transport screw 13*b*2 of the developing device 13.

Figure 4:
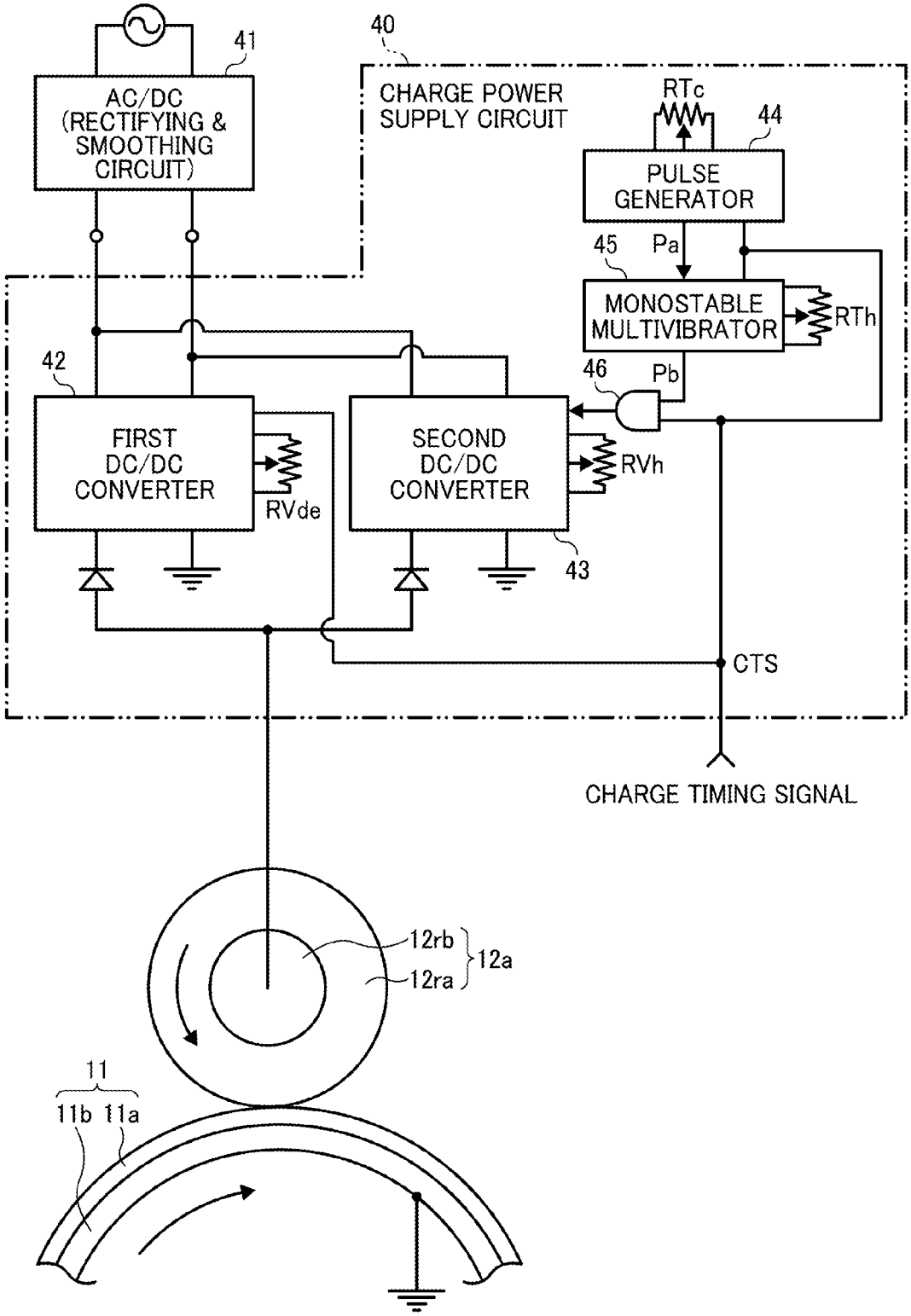
FIG. 4 is a schematic view of a configuration of a charging device in the image forming device.

FIG. 4 is a diagram illustrating a schematic structure of the charging device 12 according to this embodiment. The charging device 12 includes the charging roller 12*a* and the charger cleaning roller 12*b*. The charger cleaning roller 12*b* is used to remove contamination on the charging roller 12*a* and is arranged to contact the charging roller 12*a*. In addition, in the charging device 12 configured as described above, a predetermined voltage is applied from a charge power-supply circuit 40 to the charging roller 12*a*.

The charging roller 12*a* has a diameter of 12 [mm] and a length of about 338 [mm] and is obtained by forming an elastic layer 12*ra* (a thickness of about 3 [mm]) on a conductor 12*rb*. A direct-current voltage of −1 to −5 [kV] is applied to the charging roller 12*a* by the charge power-supply circuit 40. The photoconductor 11*a* is charged by discharge between the charging roller 12 and the photoconductor 11*a*. A voltage is applied to the charging roller 12*a* by the charge power-supply circuit 40. A voltage applied position is a center portion of the charging roller 12*a*.

The voltage applied to the charging roller 12*a* changes temporally and periodically. A movement velocity v of the photoconductor is normally 100 to 300 [mm/sec]. However, a frequency (hereinafter, referred to as a "charging frequency") f of the voltage applied to the charging roller 12*a* is set to become 7×v [Hz]. If the charging frequency becomes $f<6\times v$, vibration is generated in the photoconductor and "banding" may occur. If the charging frequency becomes $f>8\times v$, "toner filming" is likely to occur. For this reason, the charging frequency is preferably set in a range of $6\times v<f<8\times v$. The banding means image unevenness in which horizontal streaks of small pitches occur when an image in a thinly applied state such as halftones is printed. In addition, the toner filming means a state in which toner components are adhered thinly to the surface of the photoconductor over a wide area and becomes one factor of "image flow".

As methods of causing the charging roller 12*a* and the charge power-supply circuit 40 to contact each other, there are a method of pressing a conductor such as a metal against a charger directly, a method of pressing a conductive elastic body, and a method of contacting a conductive brush. However, any method may be used. A contact width of the charging roller 12*a* and a contactor connected to an output voltage contact of the charge power-supply circuit 40 is preferably smaller than a nip width where the charging roller 12*a* and the photoconductor 11*a* contact. Specifically, the contact width of the charging roller 12*a* and the contactor is preferably set to 1 [mm] or less.

The charge power-supply circuit 40 applying an alternating voltage to the charging roller in the charging device illustrated in FIG. 4 will be described below. A voltage converted from an alternating current to a direct current by a rectifying/smoothing circuit 41 is input to a first DC/DC converter 42 and a direct-current voltage having the magnitude Vde is generated by the first DC/DC converter 42. In addition, a pulsating voltage in which a frequency becomes f (a cycle Tc) and a peak value becomes Vh is generated by a second DC/DC converter 43 and a voltage obtained by superimposing the pulsating voltage on the previous direct-current voltage is applied to the charging roller 12*a*.

If a level of a signal CTS of an output control signal input terminal of charging timing becomes a high level H in only a time interval of the charging process, a pulse oscillator 44 generates a rectangular wave pulse Pa of 300 Hz or more determined by a resistance value of a potentiometer RTc. A mono stable multivibrator 45 generates a pulse Pb of a high level H for a time Th determined by a resistance value of a potentiometer RTh, using the rectangular wave pulse Pa as a trigger of rising. The pulse Pb is applied to an input terminal of an output control signal of the second DC/DC converter 43 via an AND gate 46. In the second DC/DC converter 43, a resistance value of a potentiometer RVh is changed by feedback control such that a peak value of an output voltage becomes Vh to be a target value and a voltage output (a peak value is about Vh) is performed only when a level of a signal Pb of the output control signal input terminal becomes a high level H. Because the rectifying/smoothing circuit exists in an output step of the second DC/DC converter 43, the voltage output in which the peak value is Vh becomes an ON (a continuous output of a high frequency)/OFF (interception)-like rectangular wave voltage until the voltage output passes through the output step. However, the voltage output becomes a sine wage voltage after the voltage output passes through the output step.

In the first DC/DC converter 42, a resistance value of a potentiometer RVde is changed by the feedback control such that an output voltage becomes Vde to be a target value and a voltage output (about Vde) is performed only when a level of a signal CTS of an output control signal input terminal becomes a high level H. The rectifying/smoothing circuit exists in an output step of the first DC/DC converter 42. However, because a level of the output control signal CTS becomes a high level H in a time interval of the charging process, the voltage Vde is a constant voltage at that time.

The voltage Vde can be adjusted by the potentiometer RVde, the maximum value Vh can be adjusted by the potentiometer RVh, and the frequency f can be adjusted by the potentiometer RTc.

Figure 5A:
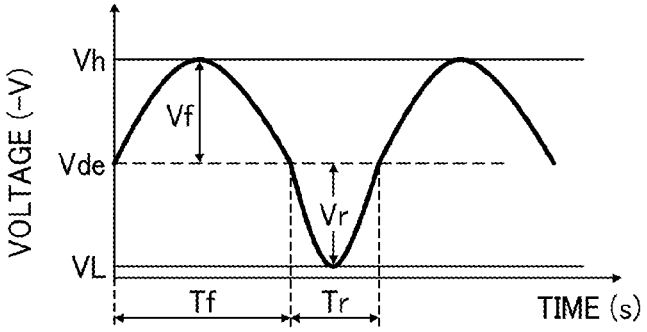
FIGS. 5A to 5D are graphs illustrating waveform examples of an alternating voltage in the charging device.

FIG. 5A is a graph illustrating a waveform example of an alternating voltage applied to the charging roller 12*a* in the first embodiment. In FIG. 5A, a broken line shows a desired surface potential Vde of a photoconductor. If a charging start voltage Vth is −650 [V] and the desired surface potential of the photoconductor is −750 [V], specific values of a maximum value Vh and a minimum value VL of the voltage applied from the charge power-supply circuit 40 to the charging roller 12*a* are as follows.

Maximum value Vh: about −1600 [V]

Minimum value VL: about +100 [V]

In the charging roller 12*a*, because an absolute value of a potential difference needed when the discharge starts is about 710 [V] in general, an absolute value Vh of a potential difference of the desired surface potential Vde of the photoconductor and the maximum value Vh is set to become 710 [V] or more (in this case, the absolute value is 850 [V]). In addition, in order to generate the reverse discharge, an absolute value Vr of a potential difference of the desired surface potential Vde of the photoconductor and the minimum value VL is also set to become 710 [V] or more (in this case, the absolute value is 850 [V] and the maximum value Vh and the minimum value VL become equal to each other).

In FIG. 5A, time when the voltage applied to the charging roller 12*a* is the maximum value Vh (except for the case in which the voltage value is Vde) for the desired surface potential Vde of the photoconductor is referred to as "pulse ON time (Tf) of a voltage component toward the normal discharge side". In addition, time when the voltage applied to the charging roller 12*a* is the minimum value VL (except for the case in which the voltage value is Vde) for the desired surface potential Vde of the photoconductor is referred to as "pulse ON time (Tr) of a voltage component toward the reverse discharge side". The pulse ON time Tr of the voltage component toward the reverse discharge side is set to be shorter than the pulse ON time Tf of the voltage component toward the normal discharge side (Tr<Tf).

Rising times of both the voltage component toward the normal discharge side and the voltage component toward the reverse discharge side are preferably set to become 0.282/f[s] (f: charging frequency) or more. In order to prevent occurrence of a white spot and a black spot on an image, it is necessary to set the absolute value Vf of the difference of the voltage component toward the normal discharge side and the desired charging voltage Vde of the photoconductor to a constant value or more. However, when the voltage waveform is the sine wave, falling time of the voltage component toward the normal discharge side rarely contributes to preventing the occurrence of the white spot and the black spot and thus, the falling time can be decreased. The falling time is generally 0.282/f[s] when the voltage waveform is the sine wave. However, the falling time can be shortened, so that the waste discharge accelerating the decrease in the film thickness of the photoconductor can be decreased, and durability of the photoconductor can be improved.

Figure 5B:
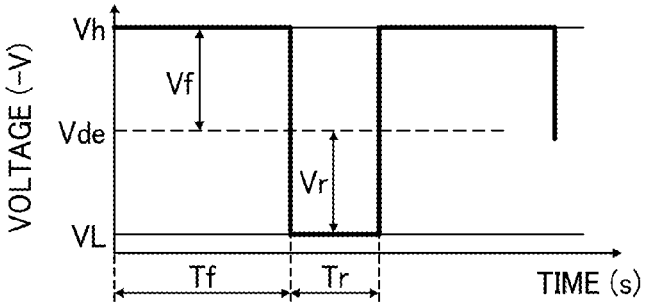
Figure 5C:
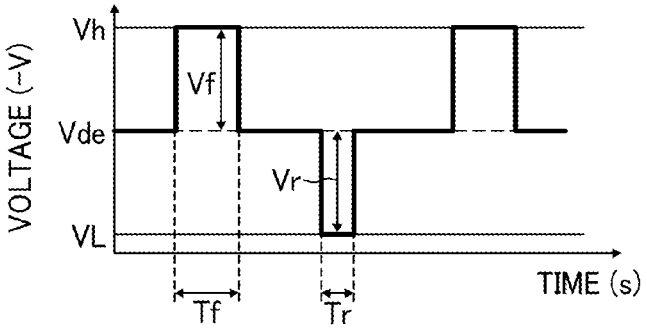
Figure 5D:
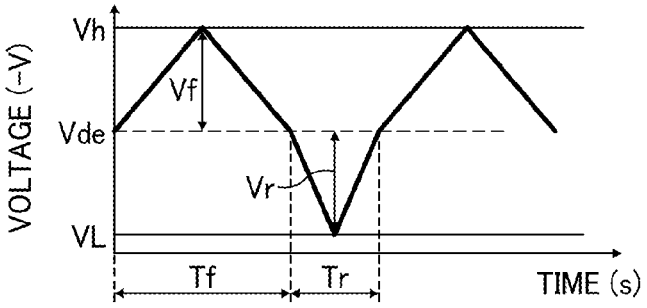

FIG. 5A illustrates the case in which the sine wave is used as the waveform example applied to the charging roller 12*a*. However, the waveform example is not limited thereto and may be a rectangular wave and a rectangular pulse wave illustrated in FIGS. 5B and 5C and a triangular wave illustrated in FIG. 5D. Thereby, a level of the reverse discharge can be decreased to a level necessary for suppressing occurrence of horizontal black streaks. As described above, Vf is dominant in a point of prevention of the occurrence of the white spot and the black spot and the pulse ON time does not contribute to preventing the occurrence of the black spots and the white spots. Therefore, the pulse ON time (Tf+Tr) illustrated in FIG. 5C may be set to become less than 50% of time (Ts) of one cycle where the voltage is applied to the charging roller 12*a*.

Second Embodiment

Figure 6A:
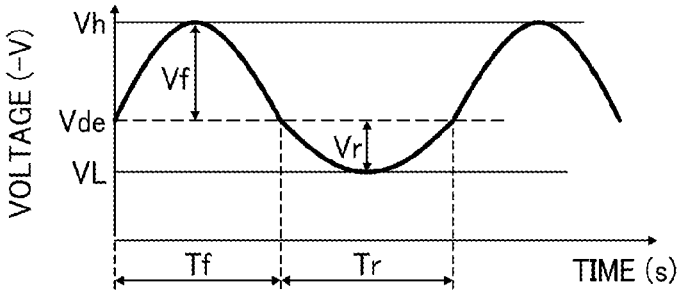
FIGS. 6A to 6D are graphs illustrating other waveform examples of the alternating voltage.
Figure 6B:
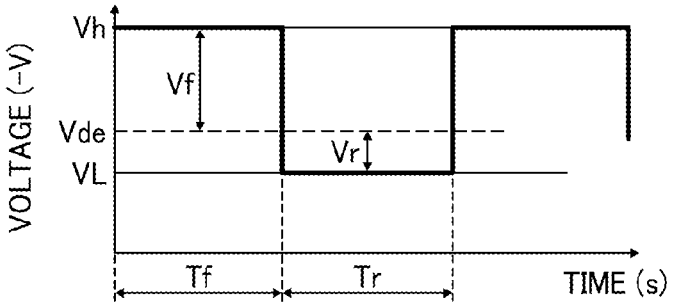
Figure 6C:
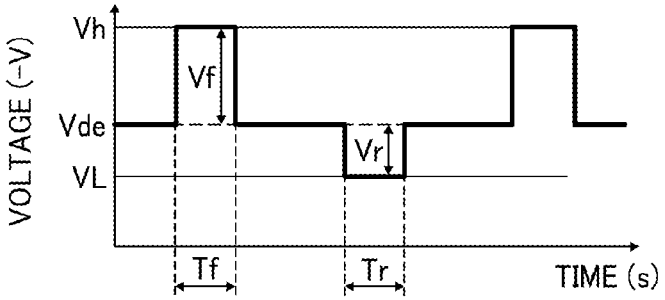
Figure 6D:
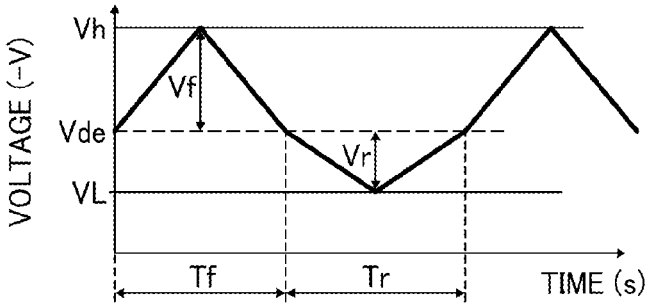

FIG. 6A is a graph illustrating a waveform example of an alternating voltage applied to a charging roller 12*a* in a second embodiment. An absolute value (Vr) of a difference of a desired surface potential Vde of a photoconductor and a minimum value VL of a voltage applied to the charging roller 12*a* is set to be smaller than an absolute value (Vf) of a difference of the desired surface potential Vde of the photoconductor and a maximum value Vh of the voltage applied to the charging roller 12*a* (VL<Vh). Pulse ON time Tr of a voltage component toward the reverse discharge side is set to be equal to pulse ON time Tf of a voltage component toward the normal discharge side. FIG. 6A illustrates the case in which a sine wave is used as a waveform example applied to the charging roller 12*a*. However, the waveform example is not limited thereto and may be a rectangular wave and a rectangular pulse wave illustrated in FIGS. 6B and 6C and a triangular wave illustrated in FIG. 6D. Thereby, a level of the reverse discharge can be decreased to a level necessary for suppressing occurrence of horizontal black streaks.

Third Embodiment

Figure 7A:
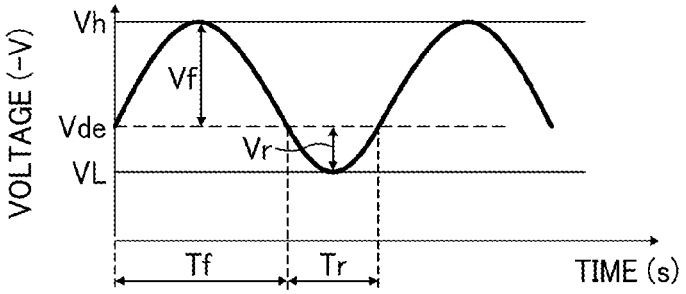
FIGS. 7A to 7D are graphs illustrating other waveform examples of the alternating voltage.
Figure 7B:
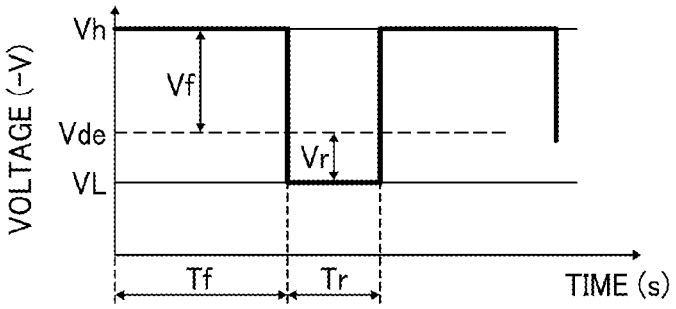
Figure 7C:
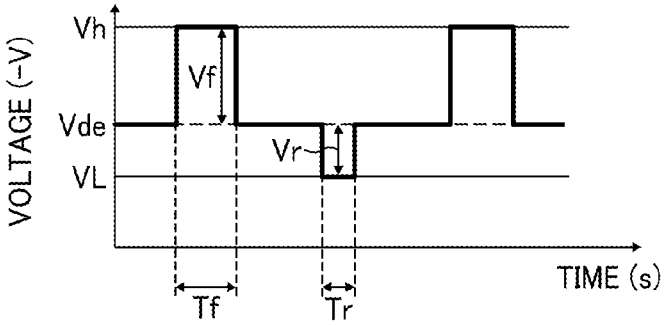
Figure 7D:
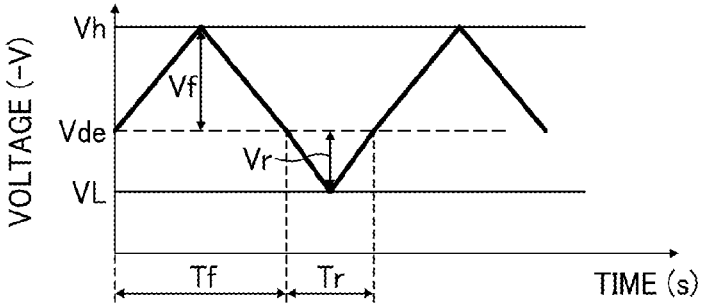

FIG. 7A is a graph illustrating a waveform example of an alternating voltage applied to a charging roller 12*a* in a third embodiment. Pulse ON time Tr of a voltage component toward the reverse discharge side is set to be shorter than pulse ON time Tf of a voltage component toward the normal discharge side (Tr<Tf) and an absolute value (Vr) of a difference of a desired surface potential Vde of a photoconductor and a minimum value VL of a voltage applied to a charging roller 12*a* is set to be smaller than an absolute value (Vf) of a difference of the desired surface potential Vde of the photoconductor and a maximum value Vh of the voltage applied to the charging roller 12*a* (VL<Vh). FIG. 7A illustrates the case in which a sine wave is used as a waveform example applied to the charging roller 12*a*. However, the waveform example is not limited thereto and may be a rectangular wave and a rectangular pulse wave illustrated in FIGS. 7B and 7C and a triangular wave illustrated in FIG. 7D. Thereby, a level of the reverse discharge can be decreased to a level necessary for suppressing occurrence of horizontal black streaks.

Fourth Embodiment

Figure 8A:
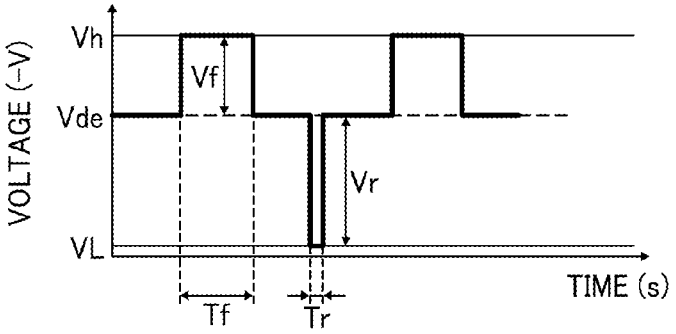
FIGS. 8A and 8B are graphs illustrating other waveform examples of the alternating device.

FIG. 8A is a graph illustrating a waveform example of an alternating voltage applied to a charging roller 12*a* in a fourth embodiment. In FIG. 8A, an absolute value (Vr) of a difference of a desired surface potential Vde of a photoconductor and a minimum value VL of a voltage applied to the charging roller 12*a* is set to be larger than an absolute value (Vf) of a difference of the desired surface potential Vde of the photoconductor and a maximum value Vh of the voltage applied to the charging roller 12*a* (VL>Vh). However, pulse ON time Tr of a voltage component toward the reverse discharge side is set to be sufficiently shorter than pulse ON time Tf of a voltage component toward the normal discharge side (Tr<Tf). Thereby, a level of the reverse discharge can be decreased to a level necessary for suppressing occurrence of horizontal black streaks.

Fifth Embodiment

Figure 8B:
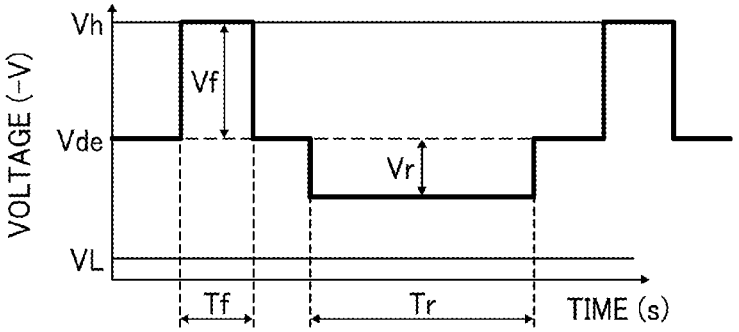

FIG. 8B is a graph illustrating a waveform example of an alternating voltage applied to a charging roller 12*a* in a fifth embodiment. Pulse ON time Tr of a voltage component toward the reverse discharge side is set to be longer than pulse ON time Tf of a voltage component toward the normal discharge side (Tr>Tf) and an absolute value (Vr) of a difference of a desired surface potential Vde of a photoconductor and a minimum value VL of a voltage applied to the charging roller 12*a* is set to be sufficiently smaller than an absolute value (Vf) of a difference of the desired surface potential Vde of the photoconductor and a maximum value Vh of the voltage applied to the charging roller 12*a* (VL<Vh). Thereby, a level of the reverse discharge can be decreased to a level necessary for suppressing occurrence of horizontal black streaks.

As described above, the level of the reverse discharge can be decreased to the level necessary for suppressing the occurrence of the horizontal black streaks, so that an amount of generation of ions cutting a molecular chain of the surface of the photoconductor and accelerating a decrease in the film thickness of the photoconductor is decreased. Therefore, both suppression of the occurrence of the horizontal black streaks and improvement of the durability of the photoconductor can be realized.

According to an embodiment of the present invention, in an AC superimposing method, occurrence of horizontal black streaks can be suppressed and durability of a photoconductor can be improved.

The above description is exemplary and the present invention achieves a particular effect for each of the following aspects.

[Aspect 1]

A charging device includes a charger, e.g., the charging roller 12*a*, disposed opposing a latent image bearer, e.g., the photoconductor 11*a*, and a power supply circuit, e.g., the power supply circuit 40, to apply an alternating voltage obtained by superimposing a pulsating voltage on a direct-current voltage to the charger. The alternating voltage generates normal discharge from the charger to a surface of the latent image bearer and reverse discharge from the surface of the latent image bearer to the charger. A pulse ON time of a voltage component toward a reverse discharge side relative to a desired surface potential Vde of the latent image bearer is shorter than a pulse ON time of a voltage component toward a normal discharge side relative to the desired surface potential Vde of the latent image bearer. According to this aspect, both suppression of occurrence of horizontal black streaks and improvement of durability of the latent image bearer can be realized.

[Aspect 2]

In the charging device according to Aspect 1, the alternating voltage generates the normal discharge from the charger to the surface of the latent image bearer and the reverse discharge from the surface of the latent image bearer, e.g., the photoconductor 11*a*, to the charger. An absolute value of a difference between a peak value of the voltage component toward the reverse discharge side relative to the desired surface potential Vde of the latent image bearer and the desired surface potential Vde of the latent image bearer is smaller than an absolute value of a difference between a peak voltage of the voltage component toward the normal discharge side relative to the desired surface potential Vde of the latent image bearer and the desired surface potential Vde of the latent image bearer. According to this aspect, both the suppression of the occurrence of the horizontal black streaks and the improvement of the durability of the latent image bearer, e.g., the photoconductor 11*a* can be realized.

[Aspect 3]

A charging device includes a charger, e.g., the charging roller 12*a*, disposed opposing a latent image bearer, e.g., the photoconductor 11*a*, and a power supply circuit, e.g., the power supply circuit 40, to apply an alternating voltage obtained by superimposing a pulsating voltage on a direct-current voltage to the charger. The alternating voltage generates normal discharge from the charger to a surface of the latent image bearer and reverse discharge from the surface of the latent image bearer to the charger. An absolute value of a difference between a peak value of a voltage component toward a reverse discharge side relative to a desired surface potential Vde of the latent image bearer and the desired surface potential Vde of the latent image bearer is smaller than an absolute value of a difference between a peak voltage of a voltage component toward a normal discharge side relative to the desired surface potential Vde of the latent image bearer and the desired surface potential Vde of the latent image bearer. According to this aspect, both the suppression of the occurrence of the horizontal black streaks and the improvement of the durability of the latent image bearer, e.g., the photoconductor 11*a* can be realized.

[Aspect 4]

In the charging device according to any one of aspects 1 to 3, the alternating voltage has a waveform in which a falling time of a voltage component generating the normal discharge is 0.282/f[s] or greater. In the case of a sine wave, the falling time is normally 0.282/f[s] (where f represents charging frequency). However, even when the falling time is decreased, this does not affect a white spot and a black spot on an image. By shortening the falling time, an application time of the voltage component toward the normal discharge side can be decreased. Therefore, waste discharge accelerating a decrease in a film thickness of the photoconductor is decreased, so that the durability of the latent image bearer, e.g., the photoconductor 11*a* can be improved.

(Aspect 5)

In the charging device according to any one of aspects 1 to 4, the alternating voltage has a waveform in which an absolute value of a difference between a peak value of a voltage component generating the reverse discharge of the alternating voltage applied to the charger, e.g., a charging roller 12*a*, and the surface potential of the latent image bearer, e.g., the photoconductor 11*a*, immediately after the normal discharge is generated is 710 [V] or greater. In the case of using the charging roller 12*a*, an absolute value (discharge start voltage) of a difference of the surface potential of the photoconductor 11*a* and the potential regarding the reverse discharge applied to the charging roller 12*a* is about 710 [V] in general. The peak value of the voltage component generating the reverse discharge is set to be the discharge start voltage of 710 [V] or greater, so that the occurrence of the horizontal black streaks can be suppressed.

[Aspect 6]

An image forming apparatus includes a rotatable latent image bearer, e.g., the photoconductor 11*a*, a charging device, e.g., the charging device 12, to charge a surface of the latent image bearer, a latent image writing unit, e.g., the writing unit 6, to form an electrostatic latent image on the surface of the latent image bearer uniformly charged with the charging device, a developing device, e.g., the developing device 13, to adhere a toner to the electrostatic latent image on the latent image bearer, e.g., the photoconductor 11*a*, and develop the electrostatic latent image, a transfer device, e.g., the intermediate transfer belt 17, to transfer a toner image formed by the toner adhered to the latent image bearer to a transfer material, and a cleaning device, e.g., the photoconductor cleaning device 15, to remove a residual untransferred toner remaining on the latent image bearer after the toner image is transferred to the transfer material. The charging device is the charging device according to any one of aspects 1 to 5. According to this aspect, both the suppression of the occurrence of the horizontal black streaks and the improvement of the durability of the latent image bearer, e.g., the photoconductor 11*a* can be realized.

[Aspect 7]

In the image forming apparatus according to aspect 6, the charger, e.g., the charging roller 12*a*, and the latent image bearer, e.g., the photoconductor 11*a*, contact each other across an entire area in a longitudinal direction of the charger. If the charger, e.g., the charging roller 12*a* and the latent image bearer, e.g., the photoconductor 11*a* do not contact each other, a variation occurs in a gap between the charger and the latent image bearer. If the peak value of the normal discharge voltage component of the voltage applied to the charger is set according to a place where the gap is widest not to cause a charging failure, a discharge hazard may increase in a place where the gap is narrow. The charger and the latent image bearer contact across the entire area in the longitudinal direction of the charger, so that the latent image bearer, e.g., the photoconductor 11*a* having the high durability can be obtained.

(Aspect 8)

The image forming apparatus according to aspect 7 further includes a cleaner, e.g., a cleaning blade 15*a*, to contact the charger, e.g., the charging roller 12*a*. In the case of using the charging roller 12*a*, because the charging roller 12*a* is rotationally driven with the photoconductor 11*a*, the cleaner can be made to contact the surface of the charging roller 12*a*. Thereby, the charging roller 12*a* can be easily cleaned, occurrence of resistance irregularity of the charging roller 12*a* can be suppressed, and a stabilized discharge state can be generated.

(Aspect 9)

In the image forming apparatus according to aspect 7 or 8, the cleaner contains foaming urethane. According to this aspect, the occurrence of the resistance irregularity of the charger, e.g., the charging roller 12*a* can be suppressed more than the configuration of the Aspect 8.

(Aspect 10)

In the image forming apparatus according to any one of aspects 7 to 9, a contact member containing a lubricant does not contact the latent image bearer, e.g., the photoconductor 11*a*. In a configuration in which the contact member containing the lubricant does not contact the latent image bearer, there may occur a problem in the durability of the latent image bearer. Meanwhile, according to this aspect, because the durability of the latent image bearer is improved in the configuration of Aspect 6, the problem does not occur. In addition, because applying unevenness or cleaning unevenness of the lubricant does not occur, a stabilized image quality can be obtained.

(Aspect 11)

In the image forming apparatus according to any one of aspects 7 to 10, a frequency f of a voltage applied to the charger, e.g., the charging roller 12*a* and a linear velocity v of the latent image bearer, e.g., the photoconductor 11*a* satisfies a relation of $6\times v<f<8\times v$. If the charging frequency satisfies a relation of $f<6\times v$, banding becomes worse and if the charging frequency satisfies a relation of $f>8\times v$, photoconductor filming becomes worse. However, the charging frequency is set in a range of $6\times v<f<8\times v$, so that the banding is suppressed and occurrence of an abnormal image can be prevented.

(Aspect 12)

A process cartridge includes the charging device, the cleaning device, and the latent image bearer of the image forming apparatus according to any one of aspects 6 to 11. The charging device, the cleaning device, and the latent image bearer are detachably attachable relative to a body of the image forming apparatus as a single unit. According to this aspect, both the suppression of the occurrence of the horizontal black streaks and the improvement of the durability of the latent image bearer, e.g., the photoconductor 11*a* can be realized and exchangeability of consumable components can be improved.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A charging device, comprising:

a charger configured to contact a latent image bearer; and a power supply circuit configured to apply to the charger an alternating voltage obtained by superimposing a pulsating voltage on a direct-current voltage, wherein the alternating voltage generates normal discharge from the charger to a surface of the latent image bearer and reverse discharge from the surface of the latent image bearer to the charger, a pulse ON time of a voltage component toward a reverse discharge side relative to a desired surface potential Vde of the latent image bearer is shorter than a pulse ON time of a voltage component toward a normal discharge side relative to the desired surface potential Vde of the latent image bearer, and the alternating voltage has a waveform in which a falling time of a voltage component generating the normal discharge is 0.282/f[s] or greater, where f represents a frequency of the alternating voltage applied to the charger.

2. The charging device according to claim 1, wherein the charger is a charging roller, and the alternating voltage has a waveform in which an absolute value of a difference between a peak value of a voltage component generating the reverse discharge and the surface potential of the latent image bearer immediately after the normal discharge is generated is 710 [V] or greater.

3. An image forming apparatus, comprising:

the latent image bearer;

the charging device according to claim 1 configured to charge the surface of the latent image bearer;

a latent image writing unit configured to form an electrostatic latent image on the surface of the latent image bearer charged by the charger;

a developing device to adhere toner configured to the electrostatic latent image on the latent image bearer and develop the electrostatic latent image into a toner image;

a transfer device configured to transfer the toner image from the latent image bearer to a transfer material; and a cleaning device configured to remove residual untransferred toner remaining on the latent image bearer after the toner image is transferred to the transfer material.

4. The image forming apparatus according to claim 3, wherein the charger is a charging roller, and the charging roller and the latent image bearer contact each other across an entire area in a longitudinal direction of the charging roller.

5. The image forming apparatus according to claim 4, wherein the cleaning device includes a cleaner disposed in contact with the charging roller.

6. The image forming apparatus according to claim 5, wherein the cleaner includes foaming urethane.

7. The image forming apparatus according to claim 4, wherein a frequency f in Hertz (Hz) of the alternating voltage applied to the charger and a linear velocity v in millimeters per second (mm/sec) of the latent image bearer satisfies a relation of $6\times v<f<8\times v$.

8. A process cartridge, comprising, the charging device, the cleaning device, and the latent image bearer of the image forming apparatus according to claim 3, wherein the charging device, the cleaning device, and the latent image bearer are detachably attachable relative to a body of image forming apparatus as a single unit.

9. A charging device, comprising:

a charger configured to contact a latent image bearer; and a power supply circuit configured to apply to the charger an alternating voltage obtained by superimposing a pulsating voltage on a direct-current voltage, wherein the alternating voltage generates normal discharge from the charger to a surface of the latent image bearer and reverse discharge from the surface of the latent image bearer to the charger, a pulse ON time of a voltage component toward a reverse discharge side relative to a desired surface potential Vde of the latent image bearer is shorter than a pulse ON time of a voltage component toward a normal discharge side relative to the desired surface potential Vde of the latent image bearer, and an absolute value of a difference between a peak value of the voltage component toward the reverse discharge side relative to the desired surface potential Vde of the latent image bearer and the desired surface potential Vde of the latent image bearer is smaller than an absolute value of a difference between a peak voltage of the voltage component toward the normal discharge side relative to the desired surface potential Vde of the latent image bearer and the desired surface potential Vde of the latent image bearer.

10. A charging device, comprising:

a charger configured to contact a latent image bearer; and a power supply circuit configured to apply to the charger an alternating voltage obtained by superimposing a pulsating voltage on a direct-current voltage, wherein the alternating voltage generates normal discharge from the charger to a surface of the latent image bearer and reverse discharge from the surface of the latent image bearer to the charger, an absolute value of a difference between a peak value of a voltage component toward a reverse discharge side relative to a desired surface potential Vde of the latent image bearer and the desired surface potential Vde of the latent image bearer is smaller than an absolute value of a difference between a peak voltage of a voltage component toward a normal discharge side relative to the desired surface potential Vde of the latent image bearer and the desired surface potential Vde of the latent image bearer, the alternating voltage has a waveform in which a falling time of a voltage component generating the normal discharge is 0.282/f[s] or greater, where f represents a frequency of the alternating voltage applied to the charger.

11. The charging device according to claim 10, wherein the charger is a charging roller, and the alternating voltage has a waveform in which an absolute value of a difference between a peak value of a voltage component generating the reverse discharge and the surface potential of the latent image bearer immediately after the normal discharge is generated is 710 [V] or greater.

12. An image forming apparatus, comprising:

the latent image bearer;

the charging device according to claim 10 configured to charge the surface of the latent image bearer;

a latent image writing unit configured to form an electrostatic latent image on the surface of the latent image bearer charged by the charger;

a developing device configured to adhere toner to the electrostatic latent image on the latent image bearer and develop the electrostatic latent image into a toner image;

a transfer device configured to transfer the toner image from the latent image bearer to a transfer material; and a cleaning device configured to remove residual untransferred toner remaining on the latent image bearer after the toner image is transferred to the transfer material.

13. The image forming apparatus according to claim 12, wherein the charger is a charging roller, and the charging roller and the latent image bearer contact each other across an entire area in a longitudinal direction of the charging roller.

14. The image forming apparatus according to claim 13, wherein the cleaning device includes a cleaner disposed in contact with the charging roller.

15. The image forming apparatus according to claim 14, wherein the cleaner includes foaming urethane.

16. The image forming apparatus according to claim 13, wherein a frequency f in Hertz (Hz) of the alternating voltage applied to the charger and a linear velocity v in millimeters per second (mm/sec) of the latent image bearer satisfies a relation of $6 \times v < f < 8 \times v$.

17. A process cartridge, comprising, the charging device, the cleaning device, and the latent image bearer of the image forming apparatus according to claim 12, wherein the charging device, the cleaning device, and the latent image bearer are detachably attachable relative to a body of image forming apparatus as a single unit.

* * * * *